United States Patent [19]

Schulz

[11] Patent Number: 4,831,668

[45] Date of Patent: May 23, 1989

[54] PADDING STRUCTURE FOR USE IN PROTECTIVE HEADGEAR

[75] Inventor: Arthur M. Schulz, Roselle, Ill.

[73] Assignee: Riddell, Inc., Chicago, Ill.

[21] Appl. No.: 210,426

[22] Filed: Jun. 23, 1988

[51] Int. Cl.[4] ..... A42B 3/00

[52] U.S. Cl. ..... 2/414; 2/425

[58] Field of Search ..... 2/411, 412, 413, 414, 2/415, 422, 425

[56] References Cited

U.S. PATENT DOCUMENTS

| | | | |
|---|---|---|---|
| 2,863,151 | 12/1958 | Morgan | 2/414 |
| 3,447,162 | 6/1969 | Aileo | 2/414 X |
| 3,577,562 | 5/1971 | Holt | 2/414 |
| 3,609,764 | 10/1971 | Morgan | 2/414 |
| 3,720,955 | 3/1973 | Rawlings | 2/415 |
| 3,843,970 | 10/1974 | Marietta et al. | 2/415 |
| 3,882,547 | 5/1975 | Morgan | 2/414 |
| 3,994,022 | 11/1976 | Villari et al. | 2/413 |
| 4,058,854 | 11/1977 | Rhee | 2/412 |
| 4,094,015 | 6/1978 | Howard et al. | 2/415 |
| 4,282,610 | 8/1981 | Steigerwald et al. | 2/414 |
| 4,558,470 | 12/1985 | Mitchell et al. | 2/414 |
| 4,651,356 | 3/1987 | Zide | 2/421 |
| 4,677,694 | 7/1987 | Crow | 2/9 |

*Primary Examiner*—Wm. Carter Reynolds

*Attorney, Agent, or Firm*—Jones, Day, Reavis & Pogue

[57] ABSTRACT

The jaw pad is formed of resilient material having a uniform thickness and formed in a curved shape corresponding to the curvature of the earflaps of the headgear. Four female snap members are secured to its back face, capable of engaging the three male snap members formed on both the left hand and right hand earflaps such that the jaw pad can be used on both the left and right sides of the headgear.

5 Claims, 1 Drawing Sheet

PADDING STRUCTURE FOR USE IN PROTECTIVE HEADGEAR

BACKGROUND OF THE INVENTION

This invention relates, generally, to protective headgear and, more particularly, to a jaw pad for an athletic helmet which can be interchangeably used on both the left-hand and right-hand sides of the helmet.

The typical athletic helmet consists of a rigid outer shell made of hard plastic material. Secured to the internal surface of the shell is a padding structure that is fit to the wearer's head so as to absorb the force of impact to which the helmet is subjected.

The padding structure consists of a plurality of resilient pads removably secured to the inside surface of the helmet shell. The pads are of varying shapes designed to protect specific portions of the wearer's head. Moreover, the interchangeable pads come in a range of thicknesses such that the helmet shell can accommodate different sized heads.

In order to removably secure the pads to the helmet shell, a plurality of sets of male snap members are fixed to the inner surface of the shell. Each of the resiliant pads is provided with a set of female snap members for mateably enaging one of the sets of male snap members. The pads can be simply and easily removed and replaced by "snapping-out" one pad and "snapping-in" another pad. The pads are designed to be easily removed and replaced so that the user, for example an athletic team's equipment manager, can easily replace worn or damaged pads and can replace pads of one thickness with pads of a different thickness such that the helmet can be fit to different size heads.

The known padding structure includes a pair of jaw pads arranged one each on the left-hand and right-hand sides of the shell. The jaw pads are basically U-shaped and are arranged on the earflaps of the shell below the ear holes to protect the hinge area of the wearer's jaw. A set of three male snap members is arranged on each of the left-hand and right-hand ear flaps to engage three female snap members formed on the associated jaw pad.

Because the male snap members of both the left-hand set and right-hand set are symmetrically arranged and the left-hand set is a mirror image of the right-hand set, the female snap members of the right-hand jaw pad can not engage the male snap members of the left-handset and vice versa. Therefore, when the prior art jaw pad system is used, it is necessary to have a matched set of jaw pads-one for the left-hand side of the helmet and one for the right-hand side of the helmet.

The necessity of having method sets of jaw pads results in two basic problems. First, the cost of manufacturing the padding structure is increased by the need to produce and package the different left-hand and right-hand jaw pads. Second, the maintenance of the helmet by the end user is complicated by the necessity of matching the jaw pads and is made more expensive by the necessity of purchasing and stocking the matched pair of jaw pads.

BRIEF DESCRIPTION OF THE INVENTION

In order to overcome the above-noted shortcomings of the prior art, the jaw pad of the present invention has been developed. The jaw pad of the present invention is shaped like the prior art jaw pad but includes four female snap members, rather than the three found on the known jaw pads, such that the jaw pad can be used with either the right-hand or left-hand sets of male snap members found on the existing helmet shell. As a result of this design, only one type of jaw pad is needed, thereby eliminating the cost of manufacturing the mating pairs of jaw pads. Moreover, because the jaw pad of the invention can be used on both the right-hand and left-hand sides of the helmet, the end user only purchase and stock one type of pad.

DETAILED DESCRIPTION OF THE INVENTION

Figures 1, 2, 3, 4, 5, 6:
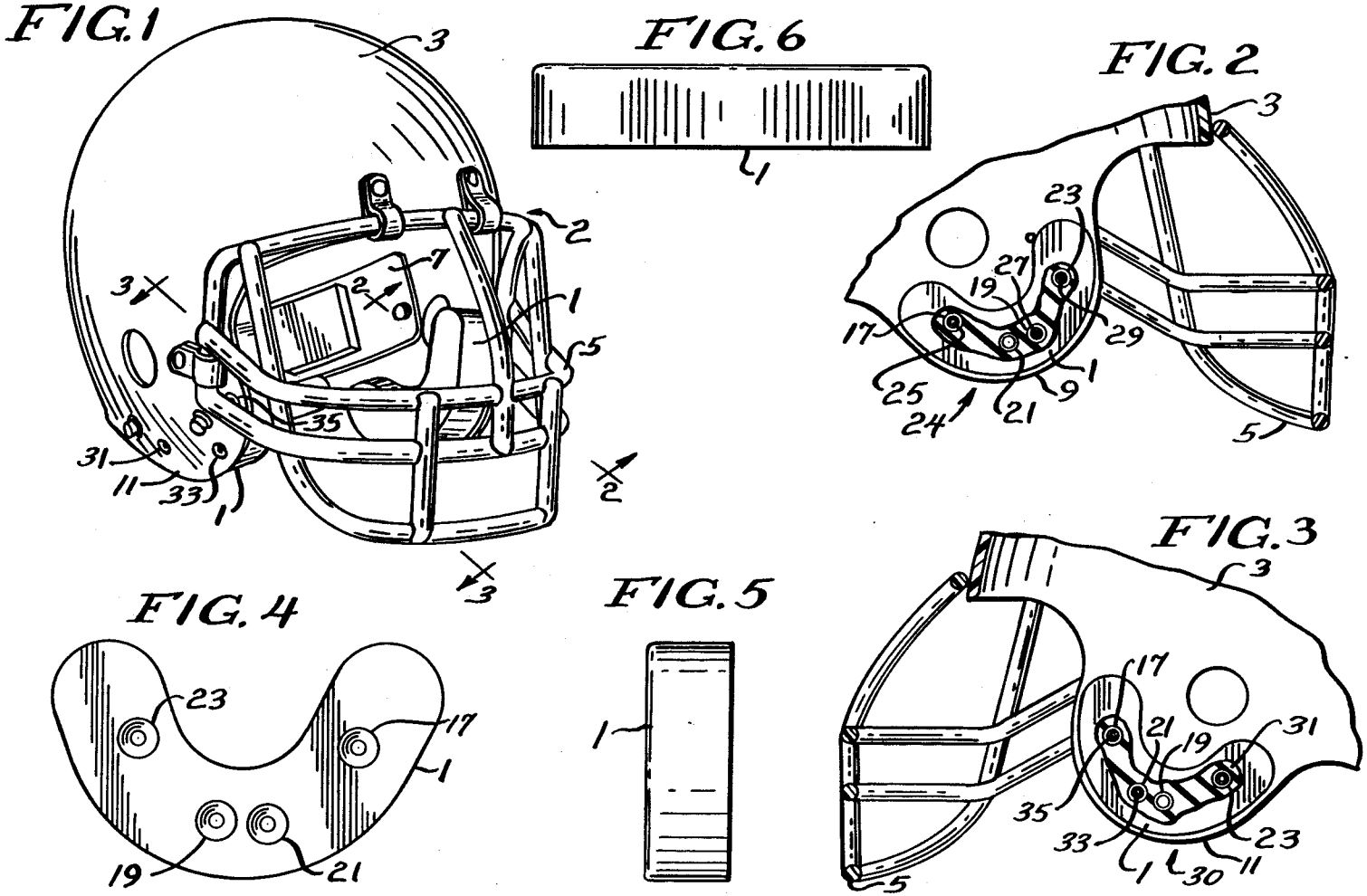
FIG. 1 is a perspective view of an athletic helmet including the jaw pad of the invention.
FIG. 2 is a cut-away view of the helmet taken along 2-2 of FIG. 1 showing the left-hand side of the inner surface of the helmet including the jaw pad of the invention.
FIG. 3 is a cut-away view of the helmet taken along 3-3 of FIG. 1 showing the right-hand side of the helmet including the jaw pad of the invention.
FIG. 4 is a front view of the jaw pad of the invention.
FIG. 5 is a side view of the jaw pad of the invention.
FIG. 6 is a top view of the jaw pad of the invention.

The jaw pad of the invention is shown, generally, at 1 in FIG. 1 in association with an athletic headgear 2. Specifically, the headgear 2 includes a rigid outer shell 3 of a hard plastic material. Secured to the inside surface of shell 3, in the area of the ear flaps 9 and 11, are the jaw pads 1 of the invention. Other attachments such as face guard 5 and neck guard 7 may also be secured to the helmet shell 3.

The shell 3 includes a first set of male snap members 24 consisting of three male snap members 25, 27 and 29 arranged about the left-hand ear flap 9 (see FIG. 2) and a second set of male snap members 30 consisting of three male snap members 31, 33, and 35 arranged about the right-hand ear flaps 11 (see FIGS. 1 and 3) as is well known in the art. As is evident from FIG. 2, male snap members 25 and 27 are spaced from one another a distance greater than that between male snap members 27 and 29. Likewise, male snap members 31 and 33 are spaced from one another a distance greater than that between male snap members 33 and 35 as shown in FIG. 3. Thus, the first set of male snap members 24 is a mirror image of the second set of male snap members 30.

As best shown in FIGS. 4–6, the jaw pad 1 of the invention consists of a piece of resilient material having a uniform thickness and formed in a curved shape corresponding to the curvature of the ear flaps 9 and 11. Attached to the back face 15 of the jaw pad are four female snap members 17, 19, 21 and 23. The female snap members are arranged such that they can removably engage both the first and second sets of male snap members 24 and 30, as will hereinafter be described.

Specifically, female snap members 17 and 19 are spaced from one another a distance equal to the distance between male snap members 25 and 27 while female snap members 19 and 23 are spaced from one another a distance equal to the distance between male snap members 27 and 29. Likewise, female snap members 23 and 21 are spaced from one another a distance equal to the distance between male snap members 31 and 33, while female snap members 21 and 17 are spaced from one another a distance equal to the distance between male snap members 33 and 35.

As a result of these spacing relationships the jaw pad 1 can be snapped onto the left-hand ear flap 9 by engaging male snap members 25, 27 and 29 with female snap members 17, 19 and and 23, respectively, as shown in FIG. 2. Furthermore, the same jaw pad 1 can be snapped onto the right-hand ear flap 11 by engaging male snap members 31, 33 and 35 with female snap members 23, 21, and 17, respectively, as shown in FIG. 3. Thus, because of the arrangement of female snap members 17, 19, 21 and 23, the jaw pad 1 of the invention can be mounted on both the left-hand and right-hand earflaps to thereby eliminate the problems associated with the known jaw pad design.

Although the invention has been described in its preferred form with a certain degree of particularity, it is understood that the present disclosure has been made by way of example only. Numerous changes in the details and construction of the combination and arrangement of parts will be apparent without departing from the spirit and scope of the invention.

What is claimed is:

1. A jaw padding structure for protective headgear of the type having a rigid outer shell including left and right ear flaps, comprising:

a first set of three male snap members arranged on the left ear flap;

a second set of three male snap members arranged on the right ear flap;

a first jaw pad formed of resilient material including first, second, third and fourth female snap members located on a face thereof capable of mateably engaging either of the first and second sets of male snap members such that when said first jaw pad is mounted to the first set of male snap members, three of the four female snap members are engaged by the three male snap members leaving one of said four female snap members disengaged and when said first jaw pad is mounted to the second set of male snap members three of the four female snap members are engaged by the three male snap members including said one disengaged female snap member; and a second jaw pad identical to said first jaw pad for mateably engaging either of the first or second sets of male snap members.

2. A jaw padding structure according to claim 1, wherein said first set of male snap members includes first, second and third male snap members arranged such that the first and second male snap members are spaced from one another a distance greater than the distance between said second and third male snap members.

3. A jaw padding structure according to claim 2, wherein said second set of male snap members includes fourth, fifth and sixth male snap members arrange such that the fourth and fifth male snap members are spaced from one another a distance greater than the distance between said fifth and sixth male snap members.

4. A jaw padding structure according to claim 2, wherein said first and third female snap members are spaced from one another a distance equal to the distance between the first and second male snap members and said third and fourth female snap members are spaced from one another a distance equal to the distance between said second and third male snap members.

5. A jaw padding structure according to claim 3, wherein said fourth and second female snap members are spaced from one another a distance equal to the distance between the fourth and fifth male snap members and said second and first female snap members are spaced from one another a distance equal to the distance between said fifth and sixth male snap members.

* * * * *